United States Patent [19]

Maruscak

[11] 4,337,804

[45] Jul. 6, 1982

[54] HOUSEHOLD SYSTEM FOR VACUUM PACKING FOODS

[76] Inventor: Ralph M. Maruscak, Apt. 416, 250 Cedar Ridge Apts., Monroeville, Pa. 15146

[21] Appl. No.: 225,693

[22] Filed: Jan. 16, 1981

[51] Int. Cl.[3] ..... B65B 31/08; B65D 33/16

[52] U.S. Cl. ..... 141/65; 141/313; 141/329; 229/62

[58] Field of Search ..... 53/434, 512; 138/44; 141/8, 65, 329, 313–317; 206/524.8; 417/198; 426/410; 229/62

[56] References Cited

U.S. PATENT DOCUMENTS

| | | | |
|---|---|---|---|
| 857,920 | 6/1907 | Boekel | 417/198 |
| 1,113,426 | 10/1914 | Galloway | 138/44 X |
| 3,980,226 | 9/1976 | Franz | 426/410 X |
| 4,018,253 | 4/1977 | Kaufman | 141/65 |
| 4,203,443 | 5/1980 | Genese | 141/329 X |

*Primary Examiner*—Frederick R. Schmidt

*Attorney, Agent, or Firm*—Reed, Smith, Shaw & McClay

[57] ABSTRACT

A household system wherein suction is provided through a needle valve (38) that is connected to suction port (26) of suction tube (10) through flexible tube (36). Food placed and sealed in container (30) is vacuum packed by penetrating a bladder section (34) of container (30) and removing air through needle valve (38).

5 Claims, 3 Drawing Figures

HOUSEHOLD SYSTEM FOR VACUUM PACKING FOODS

BACKGROUND OF THE INVENTION

1. Field of the Invention

The subject invention concerns apparatus and methods for forming a partial vacuum in food storage containers and, more particularly, for evacuating air from home freezer bags.

2. Description of the Prior Art

For many years, it has been known that foods can be preserved for long periods by freezing. It has also been known that the preservation can be extended by freezing and storing the food under a partial vacuum.

In the prior art various devices have been developed for use in commercial food processing plants for placing foods under a partial vacuum prior to freezing. Examples are shown in U.S. Pat. Nos. 3,175,590; 3,822,525; 3,834,118; and 3,945,171. However, such commercial devices are too complex and expensive to have application for home use.

Apparatus and methods known in the prior art that are intended for non-commercial application are generally unacceptable for a variety of reasons including inefficiency and unsanitary conditions. An example of one such method is shown in U.S. Pat. No. 4,018,253.

Accordingly, there was a need in the prior art for a reliable, sanitary, relatively inexpensive device suitable for forming a partial vacuum in bags and containers for freezing and storing put up in the home.

SUMMARY OF THE INVENTION

In accordance with the subject invention, a reliable, economical system is disclosed herein suitable for household use in removing air from food storage containers. The system includes a suction air from food storage containers. The system includes a suction tube having an input port that is connectable to a water tap, and a suction arm that provides suction in response to water flow into the input port. The system further includes a food storage container. The system also includes a flexible tube having a needle valve at one end, with the other end being connectable to the suction arm. The needle valve is suitable for penetrating the wall of the container such that when the other end is connected to the suction arm, the needle valve draws air out of the container.

Preferably, the arm of the suction tube includes a check valve that blocks the flow of liquid through the suction arm in the direction away from a tube section toward the suction port of the arm.

Also preferably, the container is provided with a resealable opening through which the food is placed into and taken out of the container as well as a bladder section in the wall of the container that is penetrable by the needle valve but reseals upon removal thereof.

Other details, objects and advantages of the invention will become apparent as the following description of a presently preferred embodiment thereof proceeds.

BRIEF DESCRIPTION OF THE DRAWINGS

The accompanying drawings show a presently preferred embodiment of the subject invention in which.

DESCRIPTION OF A PREFERRED EMBODIMENT

Figure 1:
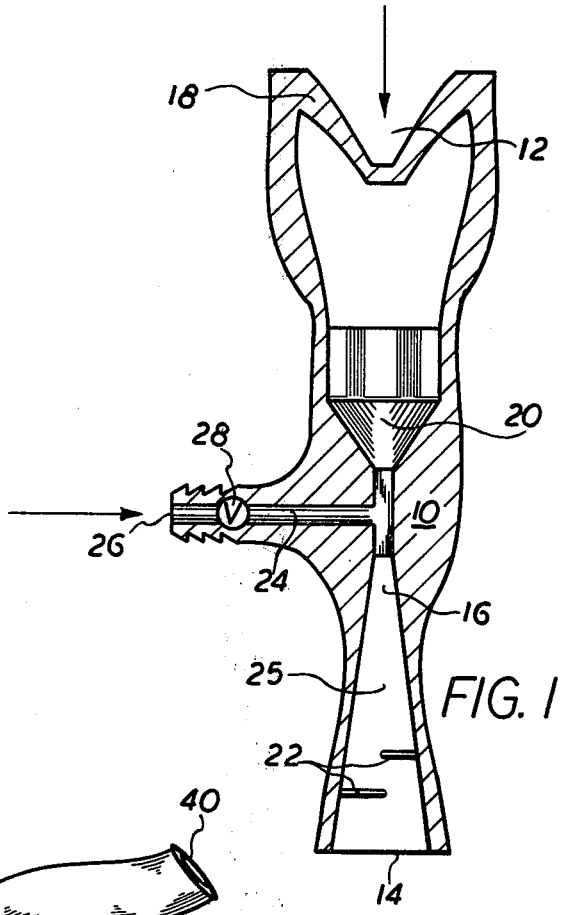
FIG. 1 is a sectional view of the suction tube disclosed herein.
Figure 3:
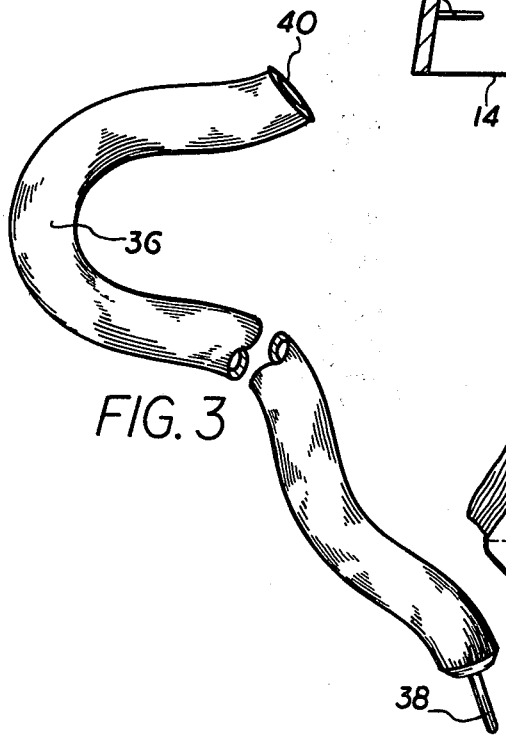
FIG. 3 illustrates a flexible tube for use in cooperation with the suction tube to remove air from the container.
Figure 2:
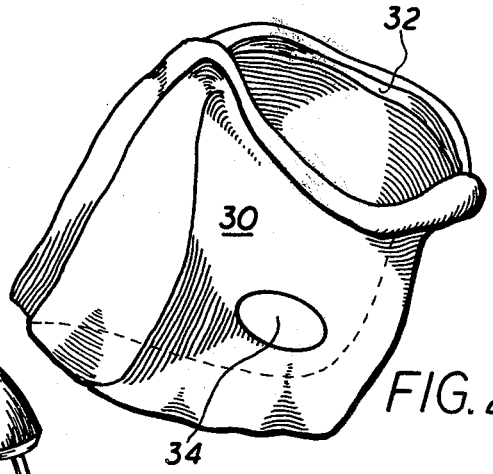
FIG. 2 illustrates a container for storing frozen foods.

A preferred embodiment of the subject invention is described in relation to FIGS. 1–3. FIG. 1 shows the presently disclosed suction tube 10 in section. The tube includes an input port 12 on one end and an output port 14 on the other end. A diffuser section 16 is located between input port 12 and output port 14 and has a smaller cross-sectional area than input port 12. Input port 12 is provided with connecting means such as flexible seal 18 so that it can be suitably connected to a household water spigot.

Preferably, the cross-sectional area of diffuser section 16 is in the range of one-half to one-sixth the cross-sectional area of input port 12. Also preferably, output port 14 has a larger cross-sectional area than diffuser section 16. A transition section 25 extends from the diffuser section 16 to the output port 14. Transition section 25 has an included angle in the range of 5° to 10°. The transition between input port 12 and the smaller diffuser section 16 is completed by tapering section 20 shown in FIG. 1. Preferably, tapered section 20 is tapered such that the included angle is in the range of 30° to 40°.

Connected to suction tube 10 is a suction arm 24 having a suction port 26. As shown in FIG. 1, suction arm 24 is provided with a check valve such as ball check valve 28 that is arranged to block the flow of liquid through suction arm 24 from suction tube 10 to suction port 26.

FIG. 2 illustrates a container suitable for storing frozen foods. More specifically, FIG. 2 shows a bag 30 made of a thin pliable plastic material that is preferably transparent. Bag 30 includes a resealable closure 32 through which food can be placed into and removed from the bag. Bag 30 also includes a bladder section 34 that is fastened in one wall or side thereof. Bladder section 34 is preferably comprised of rubber or other suitable material such that it can be penetrated by a narrow, needle-like instrument but reseals upon removal thereof.

FIG. 3 shows a flexible tube 36 with a hollow needle valve 38 located on one end thereof. Needle valve 38 is hollow along its length and is provided with holes at the tip thereof such that when suction is applied to the opposite end 40 of tube 36, air is drawn into tube 36 through the tip of needle valve 38.

In the operation of the system shown in FIGS. 1–3, suction tube 10 is connected to a household water faucet by seal 18. The end 40 of flexible tube 36 is connected to suction port 26 of suction arm 24. The water tap is then turned on so that water flows through suction tube 10 from input port 12 to output port 14. Interior baffles 22 operate to divert the stream of water at output port 14 so that the water does not splash outside the sink basin.

In response to the flow of water from input port 12 to output port 14, suction is established at needle valve 38 through suction port 26 and flexible tube 36. The suction is due to the higher velocity of the water flow in tube section 16 in comparison to the velocity of the flow at input port 12. In response to typical household tap water supplies having pressure in the range of 40 to 120 pounds per square inch, suction tube 10 as described herein provides effective suction at suction port 26. The structure of suction tube 10 has been found to be more reliable and more economical to manufacture than other suction devices known in the prior art utilizing various forms of nozzles to provide a suction condition. Examples of such nozzles are found in U.S. Pat. Nos. 530,294; 902,752; 1,113,426; and 1,216,815. Check valve 28 is provided in suction arm 28 so that, during transient conditions when the water flow is turned on or off, water does not pass through suction arm 24 into flexible tube 36.

The food to be frozen is placed in container 30 and resealable closure 32 is closed. Needle valve 38 is then inserted through bladder section 34 until substantially all the air is removed from container 30. Needle valve is thereupon removed and bladder 34 reseals so that the partial vacuum on the food is maintained until container 30 is opened at resealable closure 32.

In an alternative embodiment, container 30 can be provided without bladder section 34. In this case, needle valve 38 would be inserted through the wall of container 30. Upon removal of needle valve 38 the puncture opening in container 30 would be sealed by tape or other means.

While a presently preferred embodiment of the subject invention has been shown and described, it is to be understood that the invention is not limited thereto, but may be otherwise variously embodied within the scope of the following claims.

I claim:

1. A system for evacuating food storage containers, said system comprising:

a suction tube having an input port that is connectable to a water faucet and a suction arm that provides a low pressure condition in response to a fluid flow into said input port;

a container for holding food;

a flexible tube having a needle valve at one end thereof, said flexible tube connectable at the one end to said container by penetration thereof with the needle valve and connectable at the other end to the suction arm of the suction tube; and wherein said container is provided with a resealable opening through which the food is placed into and taken out of the container, and said container includes a self-sealing bladder portion adapted for insertion of the needle valve end of the flexible tube.

2. The system of claim 1 wherein said suction tube includes a check valve in said suction arm for preventing fluid flow out of one end of said suction arm.

3. The system of claims 1 or 2 wherein said suction tube further includes at least one baffle at the output port thereof.

4. The system of claim 1, wherein said container comprises a bag made of thin pliable plastic material.

5. A system for evacuating food storage containers, comprising:

means for drawing a vacuum;

a plastic container having a sealable opening through which food can be placed into and taken out of the container;

a flexible tube having a needle valve at one end thereof, said flexible tube connectable at the one end to said container by penetration thereof with the needle valve and connectable at the other end to said vacuum drawing means; and a bladder section connected to a wall of said plastic container, said bladder being penetrable by said needle valve and automatically resealable upon removal thereof.

* * * * *

UNITED STATES PATENT AND TRADEMARK OFFICE

CERTIFICATE OF CORRECTION

PATENT NO. : 4,337,804

DATED : July 6, 1982

INVENTOR(S) : Ralph Maruscak

It is certified that error appears in the above-identified patent and that said Letters Patent are hereby corrected as shown below:

Column 1, line 38, delete "the system includes a suction air from food".

Same Column, line 39, delete "storage containers".

In the drawing, Figure 1, a pair of angled lines should be applied to base of input port 12 and cross hatching lines should be deleted therebetween to reflect that input port 12 constitutes an open passageway through flexible seal 18. The upper portion of Figure 1 should thus appear as follows:

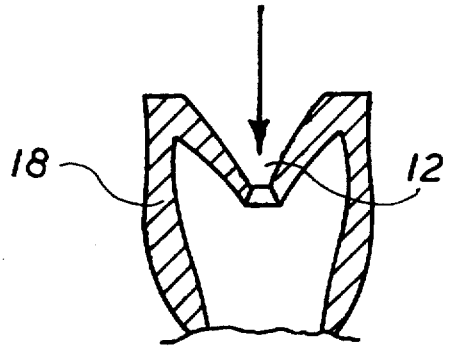

Signed and Sealed this

Sixteenth Day of November 1982

[SEAL]

Attest:

GERALD J. MOSSINGHOFF

Attesting Officer

Commissioner of Patents and Trademarks